United States Patent [19]

Bamji

[11] 3,931,960

[45] Jan. 13, 1976

[54] APPARATUS FOR CIRCULATING MOLTEN METAL

[75] Inventor: Pervez Jal Bamji, Banbury, England

[73] Assignee: Alcan Research and Development Limited, Montreal, Canada

[22] Filed: Apr. 7, 1975

[21] Appl. No.: 565,725

[52] U.S. Cl. ..... 266/34 A; 266/38; 417/50

[51] Int. Cl.[2] ..... C21C 7/00

[58] Field of Search ..... 13/26, 33; 266/34 A, 38, 266/34 T; 417/50; 310/11; 222/DIG. 2, DIG. 6, DIG. 15; 164/49, 147, 250, 251

[56] References Cited

UNITED STATES PATENTS

| | | | |
|---|---|---|---|
| 3,311,467 | 3/1967 | Polishouk et al. | 266/34 T X |
| 3,411,447 | 11/1968 | Fox et al. | 417/50 |

*Primary Examiner*—Gerald A. Dost
*Attorney, Agent, or Firm*—Cooper, Dunham, Clark, Griffin & Moran

[57] ABSTRACT

Apparatus for circulating molten metal in a furnace comprises an electromagnet the coil of which is adapted for energisation from an alternating current source and the core of which is elongate and projects from both ends of the coil. The core is disposed so that 25% to 50%, preferably 37%, of its length is at one axial side of the mid-point of the coil, and the part of the core projecting at the said one axial side of the coil has a coating or casing of a refractory material. The apparatus may be mounted with its core horizontal in a side wall of the furnace but it is preferred to dispose the core vertically with the heat shield close to the surface of the molten metal. A duct member may surround said part of the core and may be shaped to direct the molten metal laterally. A partition or other form of baffle may be disposed externally of the duct between the inlet and outlet of the duct to prevent the molten metal leaving the outlet of the duct from passing straight back to the inlet of the duct.

11 Claims, 5 Drawing Figures

APPARATUS FOR CIRCULATING MOLTEN METAL

The present invention relates to the circulation of molten metal in a melting or holding furnace.

In furnaces for melting light and heavy metal scrap it is desirable to employ a means for rapidly circulating the metal in the furnace. For example, metal circulation can be effectively used for drawing solid aluminium swarf into the body of molten metal at the charging point without causing excessive disturbance of the metal surface. Submersal of solid swarf by mechanical stirrers or the like can lead to very high melting losses through oxidation of metal at the disturbed surface.

It has already been proposed to circulate molten metal in a furnace by means of an electromagnetic circulator. The principal object of the present invention is to provide an improved electromagnetic device for this purpose.

According to this invention there is provided means for circulating molten metal in a furnace, comprising an induction coil adapted for energisation from an alternating current source, an elongate core having the coil disposed about it and projecting from both ends of the coil, said core being so disposed in relation to the coil that 25–50% of the length of the core is at one axial side of the mid-point of the coil, a refractory casing or coating protecting the part of the core projecting at said one axial side of the coil, and a heat-resistant shield protecting the coil at least at its side nearer said part of the core.

Preferably 37% of the length of the core is at said one axial side of the mid-point of the coil.

Figure 1:
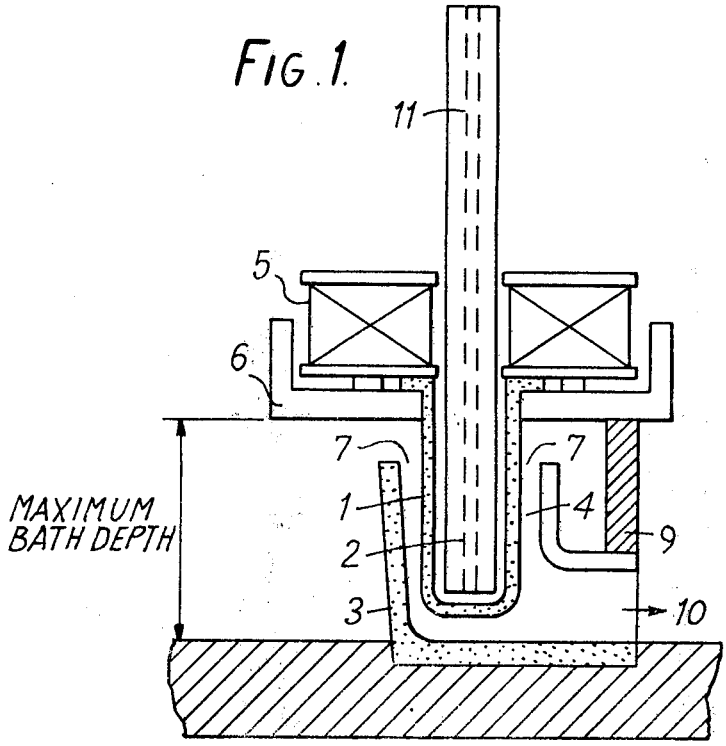
Figure 2:
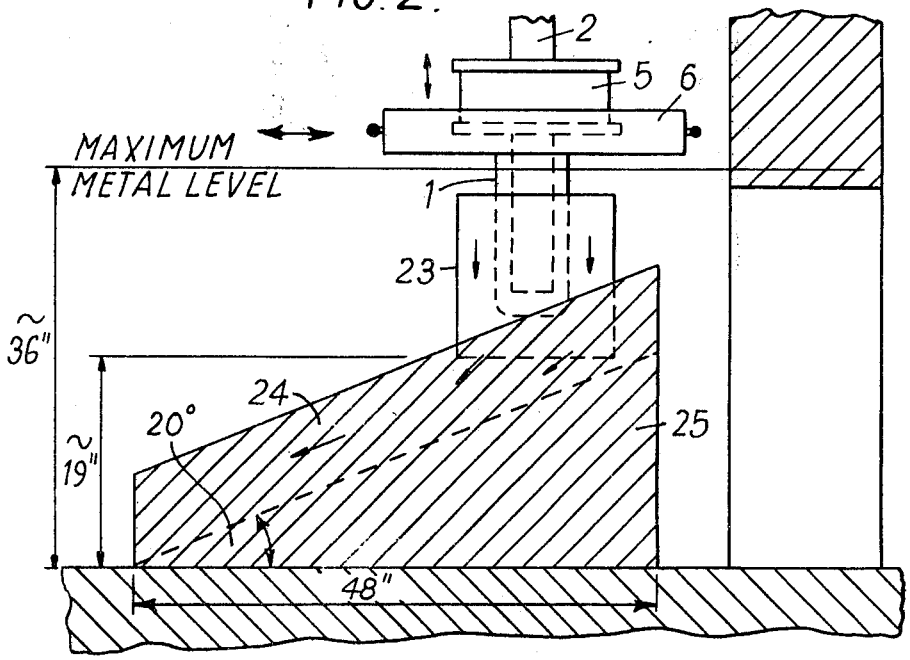
Figure 3:
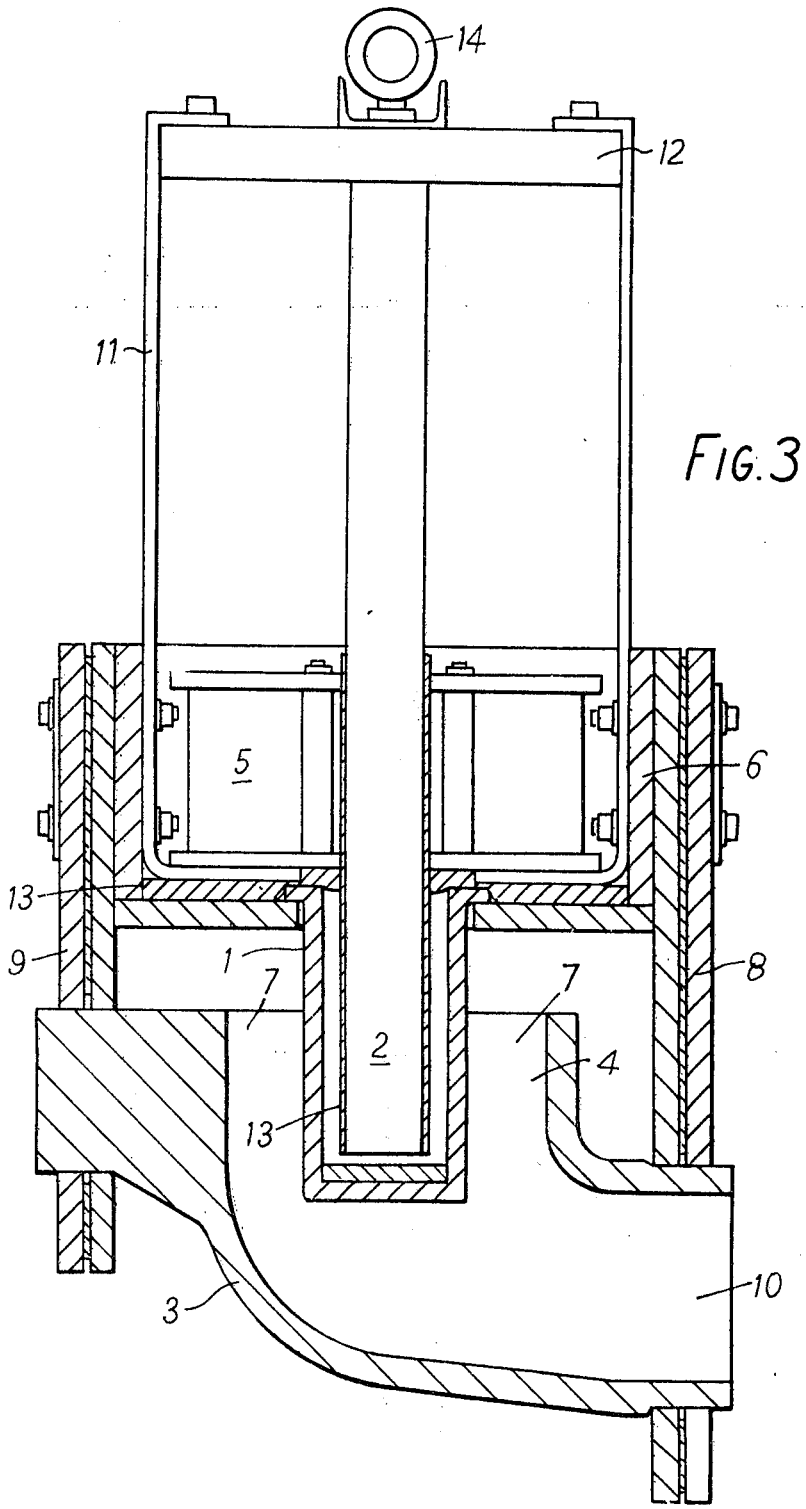
Figure 4:
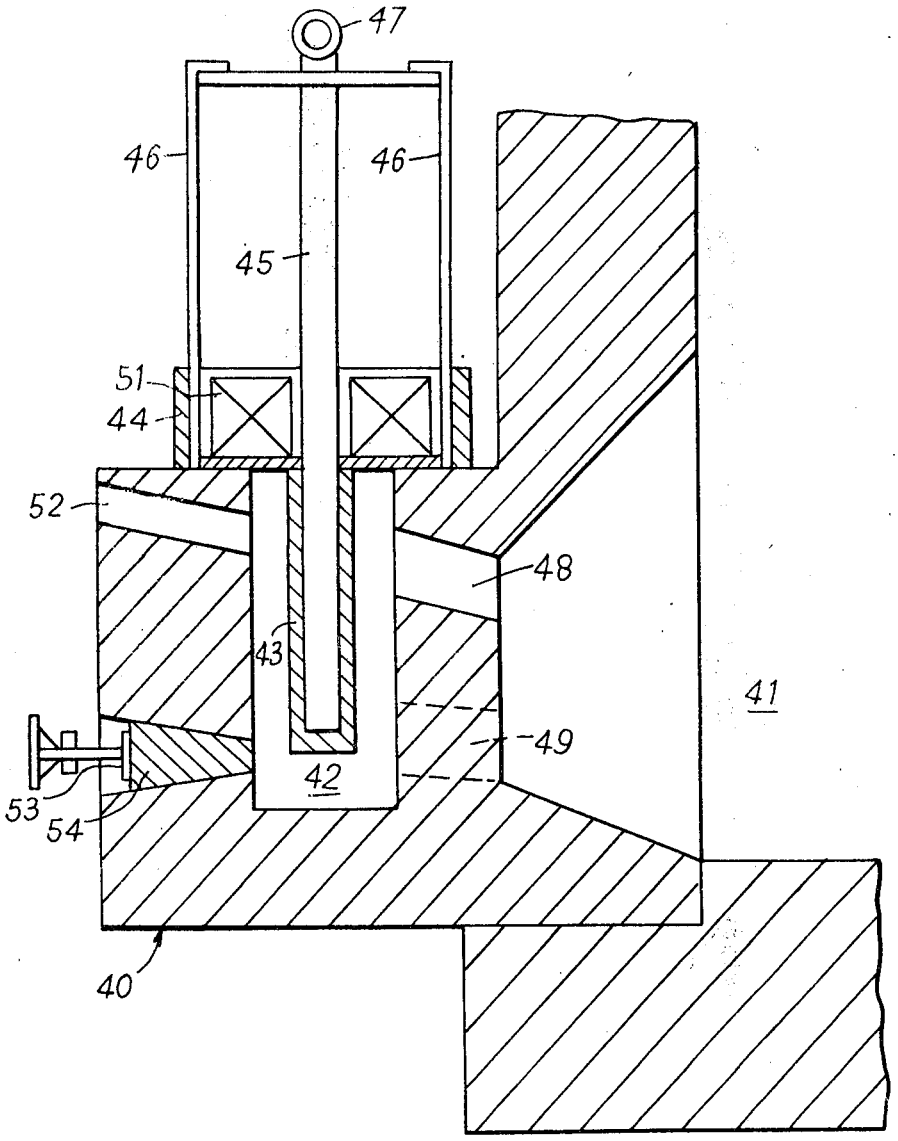
Figure 5:
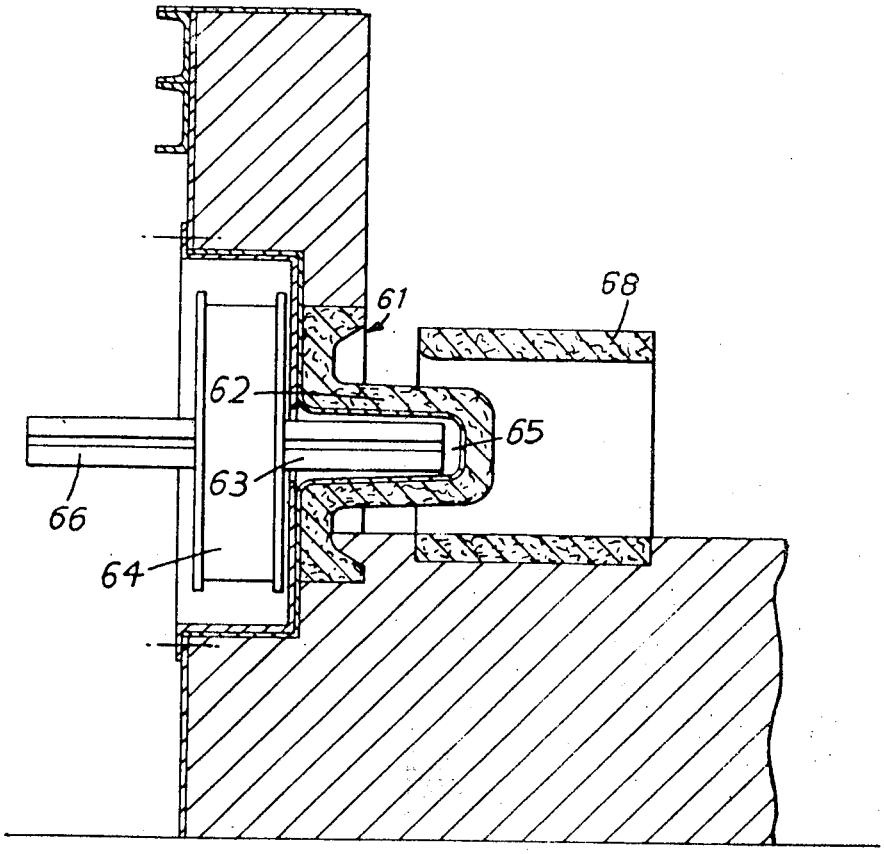

Some embodiments of the invention will now be described with reference to the accompanying drawings in which:

FIG. 1 shows one form of circulator according to the invention, which is to circulate metal into and out of an open side well of a furnace, FIG. 2 shows an alternative arrangement of circulator, FIG. 3 shows a portable form of circulator, which may be conveniently raised and lowered in accordance with change of metal level, FIG. 4 shows a further circulator arranged in a side pocket of a furnace, and FIG. 5 shows a circulator arranged horizontally.

The apparatus in each of FIGS. 1 to 3, includes an elongate core 2 arranged vertically and surrounded by a coil 5 which is above the liquid metal level. 25%–50%, preferably 37%, of the length of the core is below the midpoint of the coil, and most of this part of the core is below the liquid metal level in use of the apparatus.

The unit shown in FIG. 1 is intended to operate at a generally fixed bath depth, as shown. A cylindrical nose piece 1 with a closed lower end surrounds and protects the core 2, and extends into an elbow-shaped duct 3. Both the nose piece 1 and the duct 3 are made from a suitable material which can either be a non-magnetic metallic or ceramic refractory. The duct is keyed into position in a side well of the bath, and is open at its top below the liquid surface and has a side outlet 10. The circulator unit comprising the core, coil and nose piece 1 is shown in an operating position to which it has been lowered from the top of the duct. The nose piece lies concentric with the upwardly extending part of the duct and forms with the duct an annular channel 4 for the passage of molten metal. The coil 5 is protected by a heat barrier or shield 6 from possible damage due to heat and splashing of molten metal. The circulator unit rests on brick piers built into the furnace but not shown. The coil 5 and the heat barrier 6 are so positioned that they stand clear from the top of the duct 3, so that there is a 360° annular inlet 7 around the core for the ingress of molten metal into the annular channel 4. A partition wall 9 arranged at the entry to a side well to which outlet 10 leads ensures that the circulating metal forced to leave through the outlet 10 cannot take the direct route back to the inlet 7. The protrusion of the core 2 above the surface of the molten metal and above the coil serves the dual purposes of improving the magnetic efficiency of the device and of providing a heat exchange surface for cooling by forced air of water for example thus leading heat away from the coil 5. Coolant can also be supplied through a channel 11 in the centre of the core 2. Cooling of the core is designed to keep its temperature below its Curie point.

In certain cases the nose piece 1 can be dispensed with, and the core can be protected either by a refractory wash or by a rammable refractory material. In such a case, the core can be regarded as semi-expendable and this has two advantages over a core protected by a separate nose piece:

a. the magnetic circuit is brought closer to the molten metal and hence results in an increased efficiency; and b. it eliminates the need for using a ceramic nose piece, which is advantageous because the core is much cheaper than the nose piece.

When the coil is energised by connection with an A.C. source a secondary current is induced in the molten metal surrounding the casing and the interaction between the primary field and the field of the induced current leads to a force on the molten metal in a direction substantially lengthwise of the casing and away from the coil.

Since the force on a notional ring of molten metal surrounding the core is an inverse function of its distance from the core and the coil it is necessary for the purpose of getting good circulation in relation to the electric power input to maximise the performance of the device by careful design of the induction coil and core. We have found experimentally that the force on a metal ring surrounding the core varies considerably according to the length of the core which projects from the opposite side of the coil. This is due to the fact that altering the location of the coil along the core alters the pattern of the flux emanating from the core and changes the area through which it spreads. Further, since the reluctance of the magnetic flux is inversely proportional to the area through which it is made to spread, the reluctance can be decreased by encouraging the flux to spread over a wide area. The maximum area of the spread of flux is found to occur when the amount of core on the ring side from the mid-point of the coil is about 37% of its total length. This is therefore the position where the force on the notional metal ring is a maximum; in other words, the projecting tail end of the core should be longer than the length of core within the refractory casing for maximum force. In general it may be said that the length of the core on the ring or metal side of the mid-point of the coil should be 25–50% of the overall length of the core.

In order to ensure that the maximum force is applied to the notional ring of metal in directions parallel to the longitudinal axis of the core, the lines of magnetic force emanating at right angles to the longitudinal surfaces of the core should also intersect the ring of metal without having changed direction, i.e. the direction of the lines of magnetic flux through the notional ring of molten metal should be at right angles to the longitudinal axis of the core. This can be achieved by arranging the geometry of the coil in relation to the radial thickness of the notional ring of molten metal, for example by making the outside diameter of the coil greater than that of the notional ring of molten metal. The flux is thus constrained to travel along a longer path round the coil than when the diameter of the coil is smaller. In an example in which the outer diameter of the ring of metal was found to be 40 cm., the outside diameter of the coil was made 56 cm.

A portable-type circulator which may be operated at various bath depths may be constructed as a modification of the built-in type circulator just described. In this modification the duct 3 is connected by means of connecting bars to either the nose piece 1 or the heat barrier 6, thus enabling the entire unit to be lifted into and out of the metal. The annular channel 4 and the 360° annular inlet 7 remain as described. Similarly, the protrusion of the core 2 above the metal level and coil performs the same function as described previously.

As an example of the invention, a device constructed as shown in this FIG. 1 embodiment was located in the side-well of a 23,000-kg (50,000-lb.) furnace. The primary winding was a 230-mm diameter, 90 turn coil. The 920-mm long, 50 × 50-mm laminated steel core extended a third of its length into the molten metal. Both the coil and the core were air cooled. A number of trials were conducted, and the results of one of these trials is summarised below:

| | |
|---|---|
| Molten aluminium capacity of the furnace (including side well) | 23,000 kg. (50,000 lb.) |
| Quantity of metal in the furnace at the time of trials | 18,000 kg. (40,000 lb.) |
| Depth of metal in the side well | 600 mm. |
| Average metal temperature (measured in the side well) | 725°C. |
| Maximum velocity of metal (measured in the side well) | 29 cm/sec. |
| Maximum flow rate | 26,000 lb./min. |
| Power input to the coil | 5kW |
| Power factor | 0.22 |

Shown in FIG. 2 is a circulator unit of the portable type, having a core 2, coil 5, shield 6 and nose piece 1 as in the FIG. 1 construction, and having a straight duct 23 connected to the nose piece 1 by means of cross rods (not shown).

The whole circulator unit, including duct 23, is mounted for both vertical and horizontal movement adjacent a trough 24 inclined at 20° to the horizontal in a ramp unit 25, located in the side well of the furnace. It will be seen that metal leaving the bottom end of the duct 23 in a vertically downward direction will be given a horizontal component of motion to produce metal circulation as a result of striking the bottom of the trough.

If a change of metal level occurs the unit may be adjusted both vertically and horizontally so as to ensure that the lower end of the duct 23 is in close proximity with the inclined trough 24, whilst the heat shield 6 remains in close proximity with the surface of the body of molten metal to achieve maximum efficiency.

With this portable arrangement it is found in some circumstances possible to omit the surrounding duct 25, relying on the impact of metal on the floor of the trough to produce circulation. FIG. 3 shows a further modified form of apparatus according to the invention. As in FIGS. 1 and 2, the circulator includes a core 2 surrounded by a coil 5 at a position such that about a third of the core is below the mid-point of the coil, and the part of the core below the coil is surrounded by a protective nose piece 1. An angled duct 3 having a horizontal outlet 10 surrounds the lower part of the nose piece 1 and defines therewith an annular channel 4 with a 360° inlet 7 at its upper end. A heat shield 6 surrounds the coil and extends beneath it to protect it against possible damage due to heat and splashing of molten metal. In this embodiment, there are bolted on each side of the heat shield 6 aprons 8 and 9 which also serve to support the duct 3 and hold it clear below the heat shield 6. The apron 8 shown on the right has a width in excess of the diameter of the outlet 10 and provides a baffle reducing the chances of metal passing from the outlet 10 straight back to the inlet 7 of the duct 3. Stainless steel straps 11 are bolted to the shield and to a cruciform unit 12 also of stainless steel and extending across the top of the core 2. An eyebolt 14 is fixed to the unit 12. The straps 11 support the full weight of all the other components shown and are the means by which the unit can be lifted in and out of the metal or adjusted as to height according to the depth of metal in the furnace.

Preferably the nose piece 1, the duct 3, the heat shield 6 and the aprons 8 and 9 are made from fused silica while those areas of these parts which may come into contact with molten metal are preferably coated with a heat-resistant wash. Thermal insulation such as is shown at 13 on the outside of the lower part of the core, at the bottom of the nose piece 1, and beneath the straps 11 where they turn under the core, may be provided for protection purposes. The coil 5 is suitably water cooled and as in previous embodiments the core can have a central channel through which coolant air may be passed.

In the embodiment of FIG. 4, a circulator according to the invention is shown in a side pocket 40 of a furnace 41. A cylindrical chamber 42 is provided in the pocket, and a core 45 with nose piece 43 extends downwardly into this chamber, to define an annular vertical passage therewith. As in the previous embodiments, the core is surrounded by a coil 51 above the chamber, and thus above metal level, the coil being protected by a shield 44. Half of the core is below the mid-point of the coil. A lifting arrangement including straps 46 and a ring 47 is attached to the core and shield 44.

The chamber 42 in the pocket communicates with the main part of the furnace 41 via inclined ports 48 and 49, opening respectively adjacent the top and bottom of the chamber 42. These ports are offset in that they open into the furnace in different directions in order to provide appropriate thorough circulation of molten metal in the furnace, and to reduce recirculation from port 49 to port 48.

Access ports 52 and 53 are provided in the outer wall of the pocket for cleaning and maintenance purposes. The lower of these access ports, 53, is shown with a bung 54.

In use molten metal flows in through the upper port 48, so as to surround the core, and is forced downwards electromagnetically so as to flow out of port 49 into the furnace.

A plurality of such pockets and circulators can be provided if necessary, and arranged so as to ensure circulation of molten metal throughout the furnace. The circulators can be lifted out of the pockets during cleaning.

Referring now to FIG. 5 of the drawings, an arrangement is shown in which the core is mounted horizontally in a side well of the furnace. The casing 61, formed of refractory material, has a tubular nose piece 62, which is of generally square section. The wall thickness of the nose piece 62 is about 6.3 cm. and the internal width of the space within the nose piece 62 is about 15 cm., so that a simple laminated core 3, 10 cm × 10 cm can be fitted into it without contact with the walls. The coil 64 encircling the core is disposed in a recess in the wall of the furnace. The core is kept as cool as possible without administering any thermal shock to the refractory nose piece 62. The cooling of the core 3 is for the purpose of keeping it below its curie point. The interior of the space 65 in the nose piece 62 is lined with a blanket of heat insulating material, such as the very efficient material sold under the name "Fiberfrax". The tail end 66 of core 63 and the external surface of coil 64 are cooled by air circulation, so that the extended tail 66 serves a dual purpose of improving the magnetic efficiency of the device and of providing a heat exchange surface. The coil 64 may itself be water-cooled.

The base of casing 61 is kept thin so that the distance between the coil 4 and the molten metal in the furnace is a minimum and hence the force on the metal is increased. Further, the casing 61 is designed so that the length of its flange in contact with the surrounding refractory wall of the furnace is as large as possible.

The nose piece 62 is preferably, but not essentially, surrounded by a tunnel member 68, which acts as a means of directing the metal flowing away from the end of the nose piece 62 and as a means for protecting the nose piece from accidental damage. The passage through the tunnel member 8 is preferably of square section and is arranged to provide a passage about 5 cm. between itself and the nose piece.

The utility of the apparatus of FIG. 5 in a melting furnace is illustrated by the following example.

An electromagnetic circulator constructed as described above was installed in a melting furnace of the type having a side well to receive metal charged into the furnace.

The total capacity of the furnace was 50,000 lbs. and an aluminium charge of 40,000 lbs. was held at 715°C. With this charge a flow rate of about 10,000 lbs/min. at a velocity of about 7 cms/sec. was achieved in the side well at a power input of about 8 kw to the coil.

With this circulation rate it was found possible to melt aluminium scrap at a rate of about 10,000 lbs/hour, whereas without circulation the melting rate was about 5,000 lbs/hour.

In general, however, the arrangements of FIGS. 1 to 4 are preferred because (i) maintenance and repair are easier, (ii) the nose piece can be made much thinner with resulting saving in cost and increase in efficiency and (iii) the coil can be disposed nearer the surface of the metal.

I claim:

1. Apparatus for circulating molten metal in a furnace, comprising an induction coil adapted for energisation from an alternating current source, an elongate core having the coil disposed about it and projecting from both ends of the coil, said core being so disposed in relation to the coil that 25–50% of the length of the core is at one axial side of the mid-point of the coil, a refractory casing or coating protecting the part of the core projecting at said one axial side of the coil, and a heat-resistant shield protecting the coil at least at its side nearer said part of the core.

2. Apparatus for circulating molten metal according to claim 1 in which approximately 37% of the length of the core is at said one axial side of the mid-point of the coil.

3. Apparatus according to claim 1, wherein the said coating on the core comprises a refractory wash.

4. Apparatus according to claim 1, wherein the said coating on the core comprises a rammable refractory material.

5. Apparatus according to claim 1, further comprising an open ended duct having at least a part surrounding the core at said one side of the coil and defining a passage of annular cross-section with the encased or coated part of the core, the end of the duct nearer the coil being open for the inflow of molten metal over its full circumferential extent.

6. Apparatus according to claim 5, wherein the core is disposed vertically and wherein there is provided a ramp locatable in the furnace below the core and having therein an inclined trough aligned beneath the core.

7. Apparatus as claimed in claim 6, wherein the core, coil and shield are movable for adjustment horizontally and vertically with respect to the ramp unit.

8. Apparatus according to claim 5, wherein the core is disposed vertically and wherein the duct has upper and lower parts whereof the lower part extends at an angle to the upper part.

9. Apparatus according to claim 8 further comprising a partition extending between the lower part of the duct and the shield and serving as a baffle to prevent immediate recirculation of molten metal from the outlet back to the inlet of the duct.

10. Apparatus according to claim 1 wherein the core has a refractory casing protecting said part, which casing is about 38 cm. in length, the core length being 105–140 cm.

11. Apparatus according to claim 10, wherein the refractory casing comprises a central nose piece about the projecting part of the core and a base to be received in a side wall of the furnace.

* * * * *